US007527542B2

(12) United States Patent
Collins et al.

(10) Patent No.: US 7,527,542 B2
(45) Date of Patent: May 5, 2009

(54) TOY PLAY SET

(75) Inventors: Gary Collins, Lawndale, CA (US); Stephen Lau, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 509 days.

(21) Appl. No.: 11/343,108

(22) Filed: Jan. 30, 2006

(65) Prior Publication Data

US 2006/0128255 A1 Jun. 15, 2006

Related U.S. Application Data

(63) Continuation of application No. PCT/US2005/038262, filed on Oct. 21, 2005.

(60) Provisional application No. 60/622,211, filed on Oct. 26, 2004.

(51) Int. Cl.
*A63H 33/00* (2006.01)

(52) U.S. Cl. ..... 446/71; 446/74; 446/267; 40/406

(58) Field of Classification Search ..... 446/74, 446/267, 69, 489, 176, 71; 40/406, 409, 40/412, 439, 488; 220/503, 506, 507, 553, 220/555, 739, 703; 215/6
See application file for complete search history.

(56) References Cited

U.S. PATENT DOCUMENTS

| | | | |
|---|---|---|---|
| 141,414 | A | 8/1873 | Arnaud |
| 296,012 | A | 4/1884 | Jackson |
| 408,635 | A | 8/1889 | Sommer |
| 475,067 | A | 5/1892 | Risdon |
| 603,186 | A | 4/1898 | Griffis |
| 878,810 | A | 2/1908 | Letzkus |
| 1,103,865 | A | 7/1914 | Caler |
| 1,296,129 | A | 3/1919 | Siegel |
| 2,544,594 | A | 3/1951 | Goldfarb |
| 3,296,735 | A | 1/1967 | Djedda |
| 3,498,615 | A | 3/1970 | Toutoundjis |

(Continued)

FOREIGN PATENT DOCUMENTS

| | | |
|---|---|---|
| GB | 725420 | 3/1955 |

OTHER PUBLICATIONS

K'Nex, *K'Nex 2004* Catalogue, p. 4 (2004).

*Primary Examiner*—Gene Kim
*Assistant Examiner*—Urszula M Cegielnik
(74) *Attorney, Agent, or Firm*—Panitch Schwarze Belisario & Nadel LLP

(57) ABSTRACT

A toy play set for use in a vehicle having a beverage cup holder includes a body having first and second opposing ends and a side wall extending therebetween defining an at least partially hollow cavity within the body. The body has in a closed configuration at least the first end sized and shaped to fit at least partially into the cup holder sufficiently for the cup holder to support the body in a first generally upright orientation with the second end forming a top end of the body. The body has an open configuration in which the hollow cavity is at least partially accessible. A tank with a pump is disposed within the body and is capable of being at least partially filled with a fluid in order to play at least one predetermined game.

18 Claims, 5 Drawing Sheets

U.S. PATENT DOCUMENTS 3,578,320 A 5/1971 Goldfarb et al.
3,643,951 A 2/1972 Breslow
3,683,514 A 8/1972 Hughes
3,761,094 A 9/1973 Belisle
4,032,141 A 6/1977 Tanimura
4,103,774 A 8/1978 Shingyouchi
4,135,715 A 1/1979 Soulos
4,142,715 A 3/1979 Matsumoto
4,153,250 A 5/1979 Anthony
4,260,155 A 4/1981 Jordan
4,297,807 A 11/1981 Buettner
4,348,028 A 9/1982 Barlow
4,408,763 A 10/1983 Simons
4,433,504 A 2/1984 Terui
4,581,904 A 4/1986 Lehmann et al.
4,696,652 A 9/1987 Reeder et al.
4,713,038 A 12/1987 Wichman et al.
4,776,653 A 10/1988 Kaplan
4,869,005 A * 9/1989 Valentino ..... 40/406
4,923,429 A 5/1990 Lewis
4,928,412 A * 5/1990 Nishiyama ..... 40/324
4,946,413 A 8/1990 Lehmann et al.
4,964,831 A 10/1990 Wolff
4,966,277 A 10/1990 Razzore
5,029,700 A 7/1991 Chen
5,035,324 A 7/1991 Bertrand
5,074,561 A 12/1991 Johnson
5,167,564 A 12/1992 Lord
5,197,735 A 3/1993 Land et al.
5,209,345 A 5/1993 Haugabook
5,224,894 A 7/1993 Nelson et al.
5,236,384 A * 8/1993 Fabricant et al. ..... 446/267
5,261,848 A 11/1993 Kaplan et al.
5,291,674 A 3/1994 Torrence
5,312,285 A 5/1994 Rieber et al.
5,362,050 A 11/1994 Matsuyama
5,370,391 A 12/1994 Hilzendeger et al.
5,375,828 A 12/1994 Shikami
5,397,261 A 3/1995 Malewicki
5,419,436 A 5/1995 Powell
5,540,611 A 7/1996 Lapoint et al.
5,569,867 A 10/1996 Levine
5,632,926 A 5/1997 Dyer, Jr.
5,786,938 A 7/1998 Chang
5,803,306 A * 9/1998 Lewis ..... 220/662
5,848,722 A * 12/1998 Hanes ..... 220/741
5,851,415 A 12/1998 Thomas
5,897,418 A 4/1999 Spector
5,931,099 A 8/1999 Bruner et al.
5,980,352 A 11/1999 Rigberg
5,984,480 A 11/1999 Wong
5,996,781 A 12/1999 Glaser et al.
6,098,794 A 8/2000 Lin
6,117,502 A 9/2000 Liao
6,120,295 A 9/2000 Pracas
6,146,721 A 11/2000 Freynet
6,155,411 A 12/2000 Ho
6,203,393 B1 3/2001 Flynn
6,210,762 B1 4/2001 Pielow
6,247,729 B1 6/2001 Kaufman
6,345,822 B1 2/2002 Reynolds
6,367,799 B1 4/2002 Sippel
6,380,926 B1 * 4/2002 Ho ..... 345/163
6,506,094 B1 1/2003 Chang
6,575,807 B2 6/2003 Spector
6,619,962 B1 9/2003 Gubitosi et al.
6,652,024 B2 11/2003 Prasatek
6,695,667 B1 2/2004 Kee
6,719,606 B1 4/2004 Mukensturm
6,752,679 B1 6/2004 Lui
6,793,570 B1 9/2004 Wekstein
7,137,720 B1 * 11/2006 Finkle ..... 362/318
2002/0004942 A1 1/2002 Bryan
2002/0039609 A1 4/2002 Bezek et al.
2002/0182974 A1 12/2002 Grabianski
2004/0203317 A1 10/2004 Small
2005/0012274 A1 1/2005 Ritter et al.
2005/0017452 A1 1/2005 Stein
2005/0245168 A1 11/2005 Kay et al.
2006/0066047 A1 3/2006 Kay et al.
2006/0087076 A1 4/2006 Collins et al.
2006/0128256 A1 6/2006 Collins et al.

* cited by examiner

TOY PLAY SET

CROSS-REFERENCE TO RELATED APPLICATIONS

This patent application is a continuation of International Application No. PCT/US2005/038262, filed Oct. 21, 2005, which claims priority to U.S. Provisional Patent Application No. 60/622,211, filed Oct. 26, 2004, both entitled "Toy Play Set", the disclosures of which are incorporated herein by reference.

FIELD OF THE INVENTION

This invention generally relates to toy play sets, and in particular to toy play sets for use with conventional, unpowered, toy objects, such as figurines.

BACKGROUND OF THE INVENTION

It is known to provide play sets for use with toy objects, such as figurines. However, conventional play sets are not well-suited for use by a child while riding in a vehicle such as a car. They are usually too large to set up and use in a car or other vehicle and often lack structure to secure toy objects and other loose pieces of the play set during travel. It is believed that a toy play set adapted for use by a child riding in a vehicle and that can secure its components would be desirable.

BRIEF SUMMARY OF THE INVENTION

Briefly stated, the present invention is a toy play set for use in a vehicle having a beverage cup holder. The toy play set comprises a body having first and second opposing ends and a side wall extending therebetween. The first and second ends and the side wall define an at least partially hollow cavity within the body. The first and second ends and the side wall generally surround the hollow cavity in a closed configuration of the body. The body has in the closed configuration at least the first end sized and shaped to fit at least partially into the cup holder sufficiently for the cup holder to support the body in a first generally upright orientation with the second end forming a top end of the body. The body has an open configuration in which the hollow cavity is at least partially accessible. A tank is disposed within the body. The tank has a wall substantially surrounding a hollow interior thereof. At least a portion of the wall is at least sufficiently transparent to allow the interior to be viewed from outside of the tank. The tank is capable of being at least partially filled with a fluid in order to play at least one predetermined game. A pump is located to circulate the fluid within the tank during play of the at least one predetermined game.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
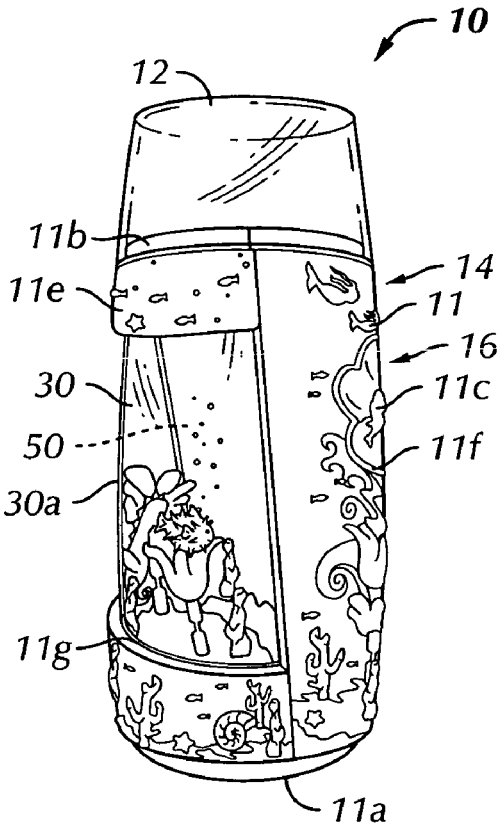
FIG. 1 is a front right perspective view of a toy play set, shown in a closed configuration, in accordance with the present invention.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1-7 a preferred embodiment of a toy play set, indicated generally at 10, in accordance with the present invention. The toy play set 10 is intended to be used while traveling, although it is within the spirit and scope that the toy play set 10 be used at times other than while traveling. Preferably, the toy play set 10 is used while traveling in a vehicle (not shown) having a beverage cup holder 80. As such, the toy play set 10 is appropriately sized to fit in a standard cup holder 80 of an automobile (not shown) or other such cup holder bearing vehicle (not shown). Preferably, one or both ends of the toy play set 10 can be tapered from a smaller diameter at the end of the toy play set 10 to a larger diameter spaced from the end. For example, the smaller diameter is suggestedly between about sixty millimeters (about two and one-quarter inches) and about eighty millimeters (about three and one-quarter inches) and preferably about seventy millimeters (about two and three-quarter inches). The larger diameter is suggestedly between about seventy millimeters (about two and three-quarter inches) and about ninety millimeters (about three and one-half inches) and preferably about eighty millimeters (about three and one-quarter inches).

Referring to FIGS. 1-5, the toy play set 10 includes a body 11 having first and second opposing ends 11*a*, 11*b* and a side wall 11*c* extending therebetween. The first and second ends 11*a*, 11*b* and the side wall 11*c* preferably define an at least partially hollow cavity 11*d* within the body 11. The first and second ends 11*a*, 11*b* and the side wall 11*c* preferably generally surround the hollow cavity 11*d* in a closed configuration 16 of the body 11 (see FIGS. 1-3), such that the body 11 can retain the loose items of the toy play set 10, which are described below. In the closed configuration 16, preferably at least the first end 11*a* of the body 11 is sized and shaped to fit at least partially into the cup holder 80 sufficiently for the cup holder 80 to support the body 11 in a first generally upright orientation 20 with the second end 11*b* forming a top end of the body 11. The body 11 further has an open configuration 18 (FIGS. 5 and 6), described in more detail below, in which the hollow cavity 11*d* is at least partially accessible.

Figure 2:
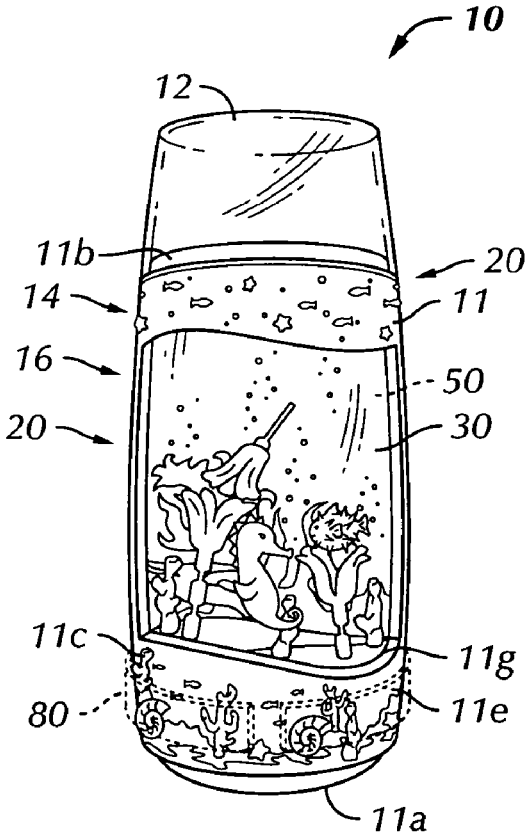
FIG. 2 is a front perspective view of the toy play set of FIG. 1.
Figure 3:
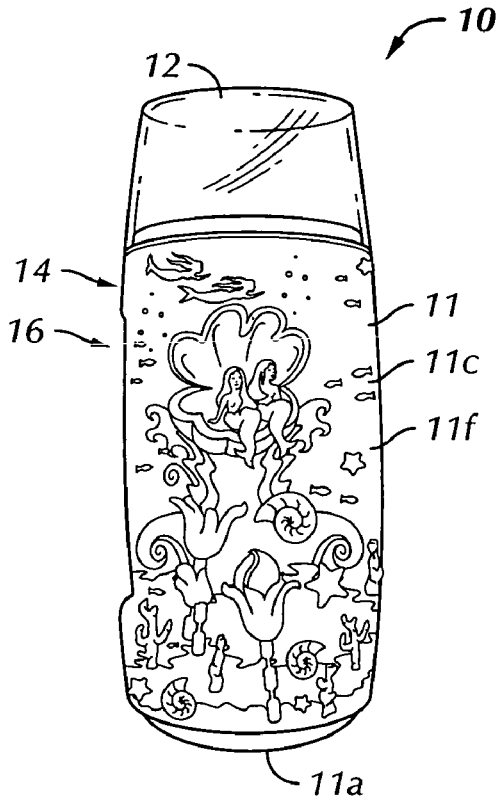
FIG. 3 is a rear perspective view of the toy play set of FIG. 1.

Referring specifically to FIGS. 1-3, when in the closed configuration 16, preferably, the body 11 of the toy play set 10 is essentially in the form of a generally cylindrical canister, including a lid 12 that preferably releasably engages with the body 11 to form a generally shell-like container. Preferably, the lid 12 is removably engageable with at least one of the first and second ends 11*a*, 11*b* of the body 11 in the closed configuration 16. The lid 12 is preferably generally cup-shaped with an open end 12*a* and an oppositely disposed closed end 12*b*. It is preferred that the lid 12 is also sized and shaped to fit at least partially into the cup holder 80, so that, when engaged with either the first or second end 11*a*, 11*b*, the lid 12 can be engaged within the cup holder 80 in order to retain the toy play set 10 therein and inhibit movement of the toy play set 10 within the vehicle.

In the closed configuration 16 of the body 11, the open end 12*a* of the lid 12 preferably interlocks with the second end 11*b* of the body 11, e.g., by tongue and groove, mating threads, bayonet connectors, or the like. When in the closed configuration 16, the body 11 and lid 12 contain (or are at least capable of containing) within the below-described components, namely, a tank 30, cliff member 40, and at least one figurine 60.

Figure 4:
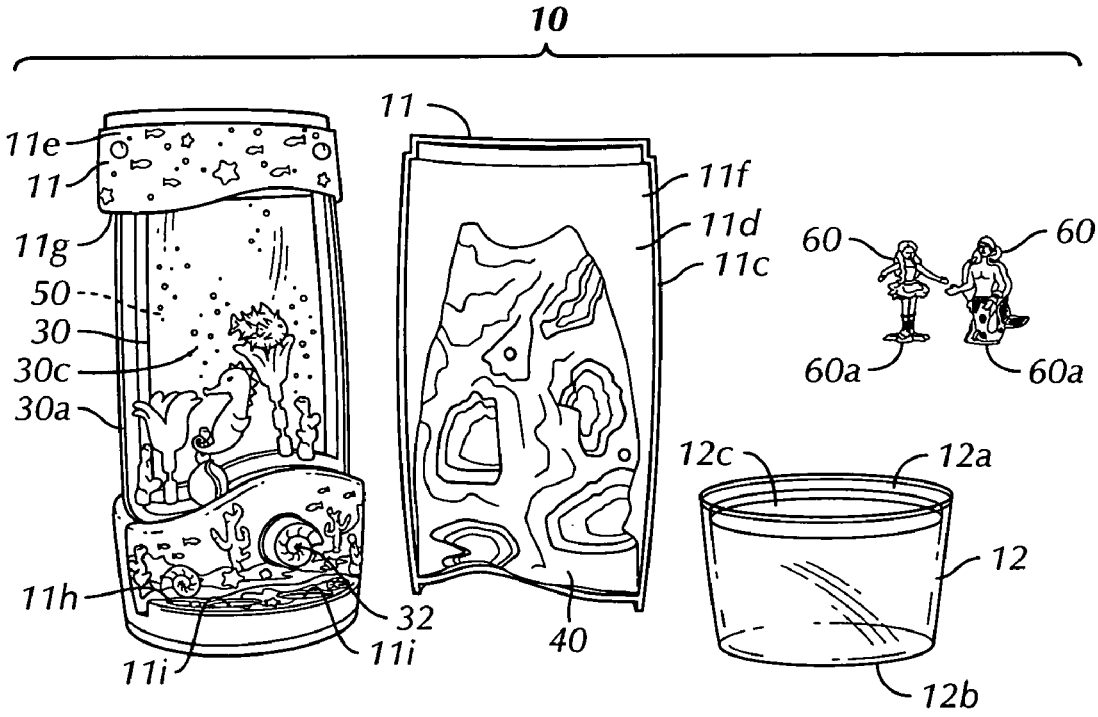
FIG. 4 is an exploded view of the toy play set of FIG. 1.
Figure 5:
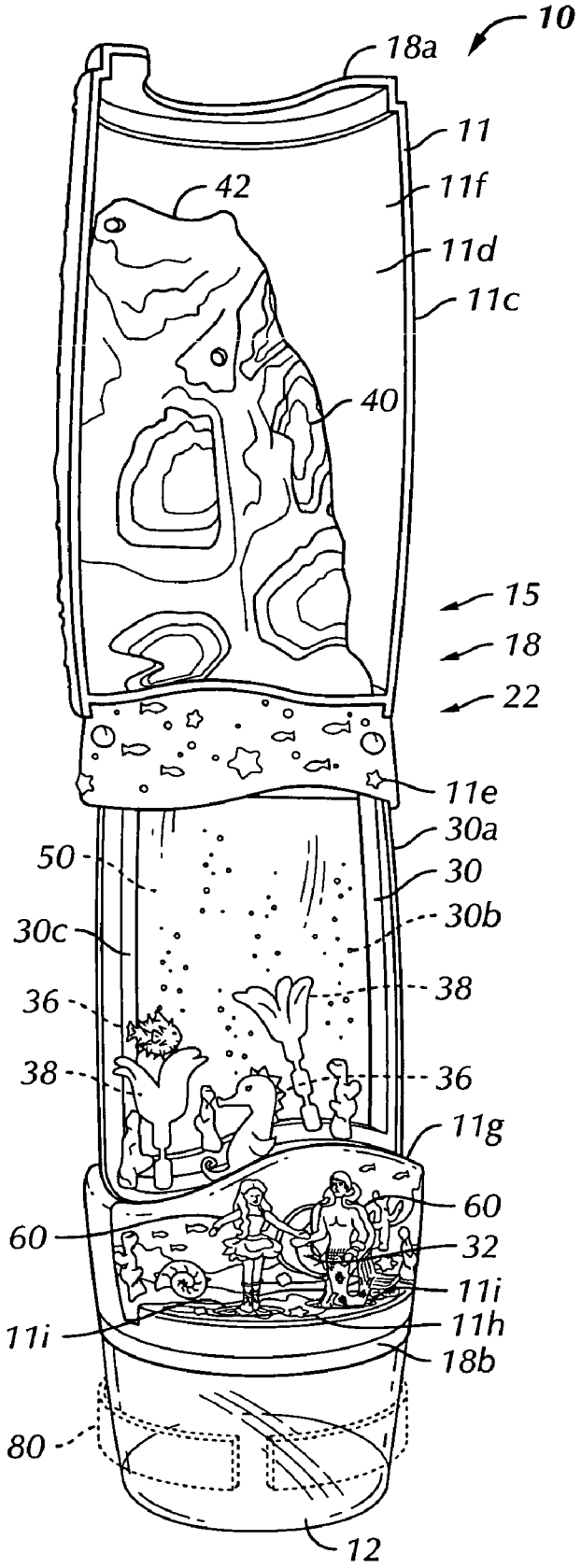
FIG. 5 is a front perspective view of the toy play set of FIG. 1, shown in an open configuration.

Referring now to FIGS. 1, 4, and 5, preferably, the body 11 includes at least first and second portions 11*e*, 11*f*. The first portion 11*e* preferably is removably engageable with the second portion 11*f*, the first and second portions 11*e*, 11*f* preferably interlocking along sides and a bottom thereof, e.g., by tongue and groove, bayonet connectors, or the like, when the body 11 is in the closed configuration 16.

Referring again to FIGS. 1-3, when in the closed configuration 16, the first and second portions 11*e*, 11*f* of the body 11 are engaged in a first arrangement 14 in which each of the first and second portions 11*e*, 11*f* forms at least part of the generally annular side wall 11*c* of the body 11. Preferably, the first portion 11*e* makes up all of a bottom portion and approximately half of the remainder of the side wall 11*c* of the body 11, and the second portion 11*f* preferably makes up the remaining half of the side wall 11*c* of the body 11.

Figure 6:
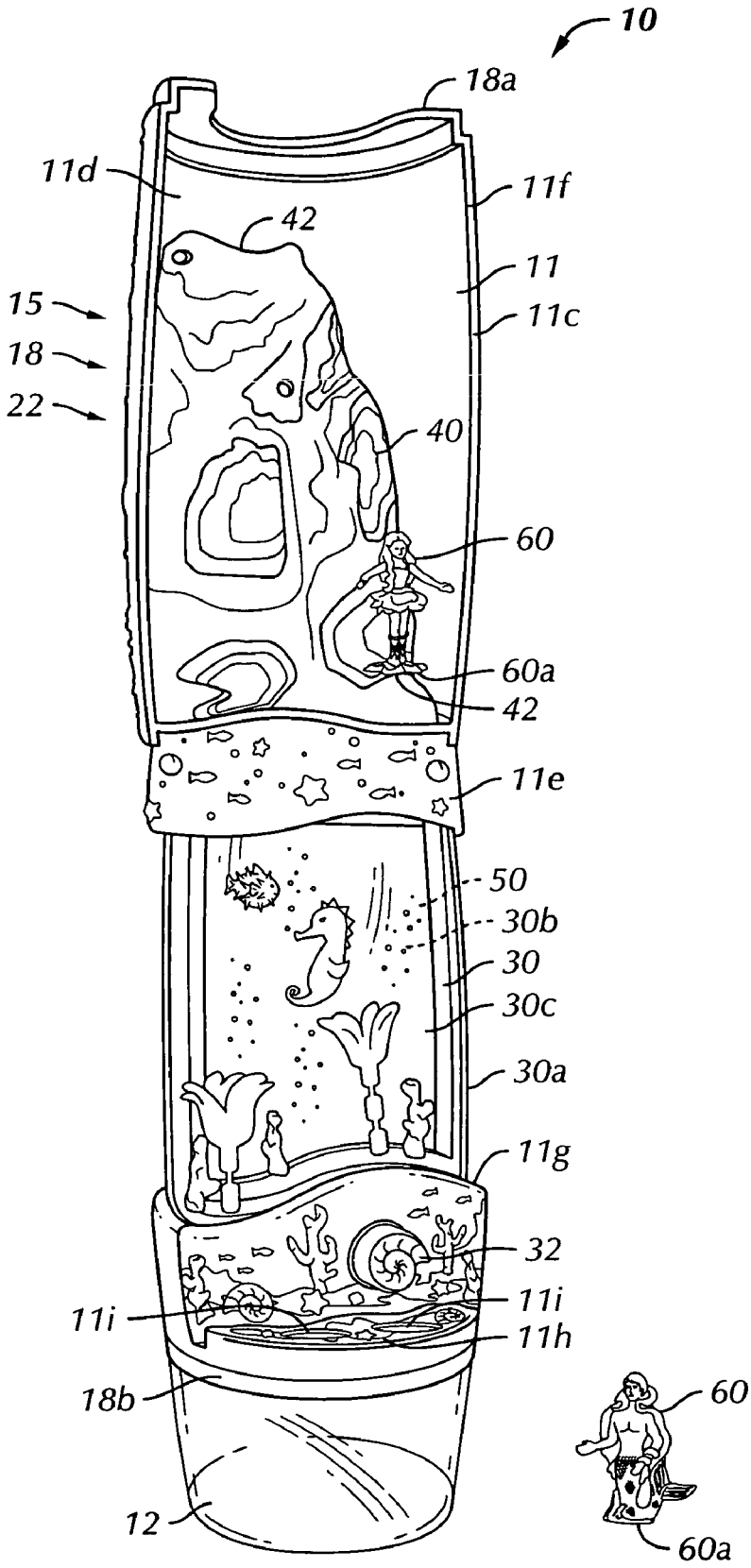
FIG. 6 is a front perspective view of the toy play set of FIG. 5.

Referring now to FIGS. 5 and 6, preferably, with the body 11 in the open configuration 18, the first and second portions 11*e*, 11*f* of the body 11 are engaged in a second arrangement 15 in which the first and second portions 11*e*, 11*f* are preferably stacked end to end. Preferably, a top end of the first portions 11*e* is engaged with a bottom end of the second portion 11*f*, e.g., by tongue and groove, bayonet connectors, press fit, snap fit, etc., when in the second arrangement 15, such that top and bottom ends, respectively, of the second and first portions 11*f*, 11*e* form opposing first and second longitudinal ends 18*a*, 18*b* of the body 11 in the open configuration 18. That is, the bottom end of the second portion 11*f* is engaged with the top end of the first portion 11*e* to form a small "tower-like" structure. Although it is preferred that the first and second portions 11*e*, 11*f* be stacked in this manner when in the second arrangement 15, it is within the spirit and scope of the present invention that the first and second portions 11*e*, 11*f* be stacked differently or otherwise configured, provided the cavity 11*d* is at least partially accessible.

It is preferred that the lid 12 be removably engageable with at least one of the first and second portions 11*e*, 11 *f* with the body 11 in the open configuration 18. More specifically, with the body 11 in the open configuration 18, it is preferred that the lid 12 be removably engageable with at least one of the first and second longitudinal ends 18*a*, 18*b*. Preferably, the lid 12 is engaged with a bottom of the first portion 11*e* (the second longitudinal end 18*b*). When engaged with one of the first and second portions 11*e*, 11*f*, the lid 12 is sized and shaped to fit at least partially into the cup holder 80, such that the lid 12 can be at least partially disposed within the cup holder 80 sufficiently to support the toy play set 10 in a second generally upright orientation 22 with the other of the first and second portions 11*e*, 11*f* forming a top end of the toy play set 10. In this way, the toy play set 10 in the open configuration 18 can be at least inhibited from tipping over, rolling, or otherwise moving within the vehicle. Alternatively, the lid 12 can be engaged with one of the first and second ends 11*a*, 11*b* of the body 11 in the closed configuration 16 and at least partially disposed within the cup holder 80 sufficiently to support the body 11 in a generally upright orientation (not shown) with the other of the first and second ends 11*a*, 11*b* forming a top end of the body 11. Although capable of being retained within the cup holder 80, alternatively, the toy play set 10 can be placed upright on a substantially flat surface (not shown) with the top cup 12 or one of the first and second ends 11*a*, 11*b* of the body 11 acting as base.

Referring to FIGS. 2 and 4-7, a tank 30 is disposed within the body 11. Preferably, the first portion 11*e* of the body 11 includes the tank 30, although it is within the spirit and scope of the present invention that the tank 30 be alternately disposed in the second portion 11*f* of the body 11. The tank 30 has a wall 30*a*, which preferably substantially surrounds a hollow interior 30*b* thereof. At least a portion 30*c* of the wall 30*a* is at least sufficiently transparent to allow the interior 30*b* to be viewed from outside the tank 30. Preferably, the tank 30 makes up at least a substantial portion of a central area of the first portion 11*e* with the tank 30 being visible from the front, back, left, and right of the first portion 11*e*. As such, it is preferred that all visible parts of the wall 30*a* of the tank 30 by at least sufficiently transparent so that the interior 30*b* can be seen from any of the front, back, left, and right sides of the first portion 11*e* of the body 11. Moreover, it is preferred that the tank 30 be disposed within an opening 11*g* in the side wall 11*c* of the body 11 so as to be visible from outside of the body 11 with the body 11 in the closed configuration 16. Although this configuration of the tank 30 within the first portion 11*e* is preferred, it is within the spirit and scope of the present invention that the tank 30 be disposed in another area of the first portion 11*e* or that the tank 30 be visible from more or less than four sides of the first portion 11*e*.

Figure 7:
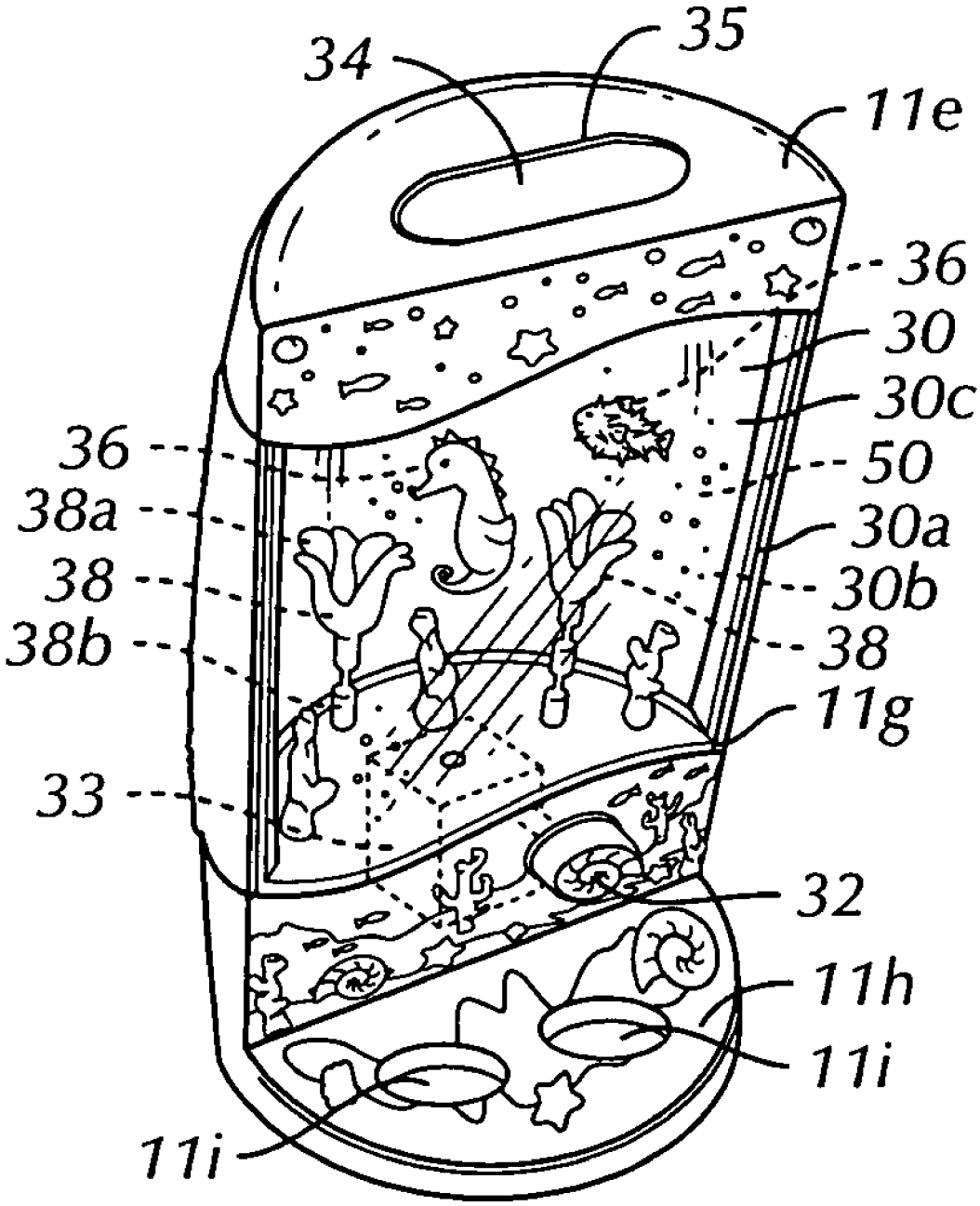
FIG. 7 is a top front perspective view of a second portion of a body of the toy play set of FIG. 5.

Referring specifically to FIGS. 5-7, the tank 30 is capable of being at least partially filled with a fluid 50 in order to play at least one predetermined game, which is described in more detail below. Preferably, the tank 30 is filled with water. Although it is preferred that water be used within the tank 30, it is within the spirit and scope of the present invention that a different fluid, provided the fluid is capable of performing as described below.

Preferably, the tank 30 includes an opening 35 through the wall 30*a*, preferably in a top surface of the wall 30*a*, to allow access to the interior 30*b* of the tank 30. The tank 30 preferably further includes a closure or plug 34 removably disposed within the opening 35 for sealingly closing the opening 35 to inhibit the water or other fluid from leaking out of the tank 30 through the opening 35. Filling of the tank 30 is achieved by removing the plug 34 from within the opening 35 in a top of the wall 30*a*, preferably located in a top of the first portion 11*e*. Water can then be poured into the opening 35 to at least partially fill the tank 30. Once at least partially filled, the plug 34 is replaced within the opening 35.

The tank 30 preferably includes at least one movable component or game piece 36 disposed within the hollow interior 30*b* for movement within the tank 30 during play of the at least one predetermined game. The at least one game piece 36 is preferably neutrally buoyant in the water or other used fluid or at least sufficiently close to neutrally buoyant so as to allow the movable component 36 to be moved within the tank by circulating the water or other fluid within the tank 30. Preferably, a pump 33, in fluid communication with the tank 30, is used for circulating the water or other fluid within the tank 30 during play of the at least one predetermined game. The pump 33 is preferably a conventional water pump disposed within the first portion 11*e* of the body 11 which forces water from a nozzle (hidden) with pushing of a button 32. The button 32 is preferably disposed within the first portion 11*e*. In this way, the pump 33 operates to circulate water within the tank 30 when the button 32 is pushed.

Preferably, the tank 30 includes more than one game piece 36, and, more preferably, includes at least two game pieces 36. It is preferable that the game pieces 36 take the form of sea animals, such as, but not limited to sea horses and/or puffer fish, although it is within the spirit and scope of the present invention that the game pieces 36 take other forms. Preferably, receptacles 38 are also located within the tank 30. It is preferable that the receptacles 38 have a cup-like top portion 38*a* attached to a top of a flexible stem 38*b*, a bottom of the stem 38*b* being fixed to a portion of the tank 30, thereby enabling the receptacle 38 to at least sway in the current created by the water pump. Preferably, the receptacles 38 are formed to resemble plant life found in the sea, although it is within the spirit and scope of the present invention that the receptacle 38 take another form.

Referring to FIGS. 4 and 5, the toy play set 10 further includes at least one figurine 60 for use therewith during play. Preferably two figurines 60 are included with the toy play set 10, although it is within the spirit and scope of the present invention that there be more or less than two figurines 60. The figurines 60 each preferably include a base 60*a* having a generally flat bottom surface to enable the figurines 60 to stand upright on a generally flat surface. Preferably, the figurines 60 are formed to resemble people and/or mermen/mermaids, although it is within the spirit and scope of the present invention that the figurines 60 take alternate forms.

Referring now to FIGS. 4-7, a bottom of the first portion 11*e* of the body 11 preferably forms a substantially flat stage 11*h* extending perpendicularly outwardly from below the tank 30 and button 32. Preferably, two display locations 11*i* are disposed within a top surface of the stage 11*h*. The display locations 11*i* are essentially small depressions in the top surface of the stage 11*h*, sized to accommodate bases 60*a* of figurines 60 for use with the toy play set 10. The display locations 11*i* aid in retaining the figurines 60 on the stage 11*h* during play.

Referring to FIGS. 4-6, a cliff member 40 is engaged with an interior surface of the second portion 11*f* of the body 11. Preferably, the cliff member 40 extends slightly outwardly from the interior surface of the second portion 11*f* and at least partially resembles a cliff-like formation. Preferably, display locations 42 are located within the cliff member 40. Similar to the display locations 11*i* of the first portion 11*e*, the display locations 42 are preferably small depressions within the cliff member 40, which aid in retaining the bases 60*a* of the figurines 60 during play.

Referring to FIGS. 1-6, the toy play set 10 is intended to be stored in the closed configuration 16 (FIGS. 1-3), and can be placed in the open, play configuration 18 (FIGS. 5 and 6) when a user wishes to play with the toy play set 10. To place the toy play set 10 in the open configuration 18, the lid 12 is removed from one of the first and second ends 11*a*, 11*b* of the body 11 and the body 11 is separated into the first and second portions 11*e*, 11*f* (FIG. 4). The lid 12 is preferably engaged with the bottom end of the first portion 11*e* of the body 11 (the second longitudinal end 18*b*) to extend downwardly therefrom. The second portion 11*f* of the body 11 is then connected to the first portion 11*e*, such that the bottom of the second portion 11*f* engages with the top of the first portion 11*e*, e.g., by suitable means such as, but not limited to, tongue and groove, bayonet connectors, etc., to form a small "tower-like" structure.

The structural elements of the toy play set 10 are preferably fabricated from conventional polymeric materials, such as polypropylene. It is preferable that the tank 30 be made from transparent polypropylene to enable one to see within the tank 30. Although this is preferred, it is within the spirit and scope of the present invention that the structural elements of the toy play set 10 be made of a different material, so long as the toy play set 10 is capable of performing in the manner described herein.

In use, when in the closed configuration 16, the toy play set 10 stores all of the above-described components of the toy play set 10 within the body 11 and lid 12. When it is desired to play with the toy play set 10, the body 11 can be placed in the open configuration 18, as described above, or in other open configurations with the first and second portions 11*e*, 11*f* separated or joined together in some configuration other than the closed configuration 16 of FIGS. 1-3. A user can then maneuver the figurines 60 around, on, and/or near the toy play set 10, placing the figurines 60 at the display locations 11*i* of the stage 11*h* of the first portion 11*e* of the body 11 and/or the display locations 42 of the cliff 40 of the second portion 11*f*. The user can also play a game using the tank 30, preferably filled with water. In playing the game, the user pushes the button 32 to operate the pump 33 within the first portion 11*e*, circulating the water therein and moving the game pieces 36 around the interior 30*b* of the tank 30, with the object of the game being to locate each of the game pieces 36 within one of the receptacles 38. When the user finishes or otherwise tires of playing with the toy play set 10, the toy play set 10 can be placed back into the closed configuration 16 with the figurines 60 held therein. In this way, the toy play set 10 is self-contained with little chance of losing components of the toy play set 10 within the vehicle.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

We claim:

1. A toy play set for use in a vehicle having a beverage cup holder, the toy play set comprising:

a body having first and second opposing ends and a side wall extending therebetween, the first and second ends and the side wall defining an at least partially hollow cavity within the body, the first and second ends and the side wall generally surrounding the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body having an open configuration in which the hollow cavity is at least partially accessible, the body including at least a first portion defining the first and second ends of the body in the closed and open configurations of the body and a second portion removably engaged with the first portion between the first and second ends to define the closed configuration of the body and being separated from the first portion between the first and second ends to define the open configuration of the body;

a tank disposed within the body, the tank having a wall substantially surrounding a hollow interior thereof, at least a portion of the wall being at least sufficiently transparent to allow the interior to be viewed from outside of the tank, the tank being configured to be at least partially filled with a fluid in order to play at least one predetermined game, by inclusion of an opening to allow access to the interior of the tank;

a closure removably disposed within the tank opening to sealingly close the opening to inhibit the fluid from leaking out of the tank through the opening; and a pump located to circulate the fluid within the tank during play of the at least one predetermined game.

2. The toy play set of claim 1, wherein the tank includes at least one movable component disposed within the hollow interior for movement in fluid within the tank by operation of the pump.

3. The toy play set of claim 2, wherein the at least one movable component is sufficiently neutrally buoyant in the fluid to allow the movable component to be moved within the tank by circulating the fluid within the tank.

4. The toy play set of claim 1 further comprising:

a lid removably engageable with at least one of the first and second ends of the body in the closed configuration.

5. The toy play set of claim 4, wherein the lid is generally cup-shaped with an open end and an oppositely disposed closed end.

6. The toy play set of claim 5, wherein the lid is sized and shaped to fit at least partially into the cup holder, such that, with the lid engaged with one of the first and second ends of the body, the lid can be placed within the cup holder sufficiently for the cup holder to support the body in a second generally upright orientation with the other of the first and second ends forming a top end of the body.

7. The toy play set of claim 1, wherein the second portion of the body is generally semi-annular.

8. The toy play set of claim 1, wherein, with the body in the closed configuration, the first and second portions are engaged side-by-side in a first arrangement so that each of the first and second portions forms at least part of the side wall of the body, the side wall of the body being generally annular.

9. The toy play set of claim 8, wherein, with the body in the open configuration, the first and second portions of the body are engaged in a second arrangement in which the first and second body portions are stacked end to end.

10. The toy play set of claim 9, further comprising a lid removably engageable with at least the first one of the first and second portions with the body in the open configuration.

11. The toy play set of claim 10, wherein the lid is generally cup-shaped with an open end and an oppositely disposed closed end.

12. The toy play set of claim 11, wherein the lid is sized and shaped to fit at least partially into the cup holder, such that, with the lid engaged with one of the first and second portions, the lid can be placed within the cup holder sufficiently for the cup holder to support the toy play set in a second generally upright orientation with the other of the first and second portions forming a top end of the toy play set.

13. The toy play set of claim 1, wherein the tank is disposed within an opening in the side wall of the body so as to be visible from outside of the body with the body in the closed configuration.

14. The toy play set of claim 1, further comprising at least one figurine for use with the play set during play.

15. A toy play set for use in a vehicle having a beverage cup holder, the toy play set comprising:

a body having first and second opposing ends and an annular side wall extending therebetween, the first and second ends and the annular side wall defining an at least partially hollow cavity within the body, the first and second ends and the side wall generally surrounding the hollow cavity in a closed configuration of the body, the body having in the closed configuration at least the first end sized and shaped to fit at least partially into the cup holder sufficiently for the cup holder to support the body in a first generally upright orientation with the second end forming a top end of the body, the body including at least a first portion defining the first and second ends of the body in the closed configuration of the body and a separate second portion removably engaged side-by-side with the first portion between the first and second ends in the closed configuration of the body so that each of the first and second portions forms at least part of the annular side wall of the body, and the body having an open configuration in which the first portion defines the first and second ends of the body and the hollow cavity is at least partially accessible between the first and second ends, and the first and second body portions are releasably engaged together end to end at the second end of the body with the second body portion extending away from the first first body portion and first end of the body.

16. The toy play set of claim 15 further comprising:

a tank disposed within the body, the tank having a wall substantially surrounding a hollow interior thereof, at least a portion of the wall being at least sufficiently transparent to allow the interior to be viewed from outside of the tank, the tank being configured to be at least partially filled with a liquid in order to play at least one predetermined game.

17. The toy play set of claim 16 further comprising a manually operable pump operably coupled with the tank to circulate the liquid within the tank during play of the at least one predetermined game.

18. The toy play set of claim 16, wherein the tank further includes an opening to allow access to the interior of the tank to at least fill the tank with liquid and further comprising a closure removably disposed within the opening to sealingly close the opening to inhibit the liquid from leaking out of the tank through the opening.

* * * * *